US006491370B2

(12) United States Patent
Momose

(10) Patent No.: US 6,491,370 B2
(45) Date of Patent: Dec. 10, 2002

(54) INK JET RECORDING APPARATUS

(75) Inventor: Kaoru Momose, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 6 days.

(21) Appl. No.: 09/726,511

(22) Filed: Dec. 1, 2000

(65) Prior Publication Data

US 2001/0012029 A1 Aug. 9, 2001

(30) Foreign Application Priority Data

Dec. 1, 1999 (JP) ..... 11-342037
Apr. 10, 2000 (JP) ..... 2000-108353

(51) Int. Cl.[7] ..... B41J 2/165
(52) U.S. Cl. ..... 347/30; 347/29; 347/32
(58) Field of Search ..... 347/30, 29, 32, 347/31, 33, 45, 68

(56) References Cited

U.S. PATENT DOCUMENTS

| | | | | | |
|---|---|---|---|---|---|
| 4,374,223 | A | * | 2/1983 | Van Raamsdonk et al. | 524/245 |
| 5,471,230 | A | * | 11/1995 | Saito et al. | 347/29 |
| 5,504,508 | A | | 4/1996 | Hashimoto | 347/24 |
| 5,559,536 | A | | 9/1996 | Saito et al. | 347/25 |
| 5,883,645 | A | * | 3/1999 | Ikado et al. | 347/30 |
| 6,068,364 | A | * | 5/2000 | Kusumi et al. | 347/29 |
| 6,097,412 | A | * | 8/2000 | Tsukada et al. | 347/68 |
| 6,158,840 | A | * | 12/2000 | Kobayashi et al. | 347/33 |

FOREIGN PATENT DOCUMENTS

| | | | | |
|---|---|---|---|---|
| EP | 0 844 092 A2 | | 5/1998 | B41J/2/165 |
| JP | 358173670 A | * | 10/1983 | 347/22 |
| JP | 405077433 A | * | 3/1993 | 347/29 |
| JP | 406099584 A | * | 4/1994 | 347/29 |
| JP | 06-238915 A | | 8/1994 | |
| JP | 9-123469 A | | 5/1997 | |
| JP | 11-058753 A | | 3/1999 | |

OTHER PUBLICATIONS

Harcourt, Academic Press dictionary of Science and Technology, Christopher Morris, Jan. 15, 1992.*

Japanese Abstract No. 10202908, dated Aug. 4, 1998, Minoru.

Japanese Abstract No. 61195850, dated Aug. 30, 1986, Masaharu.

* cited by examiner

*Primary Examiner*—Lamson Nguyen
*Assistant Examiner*—Shih Wen Hsieh
(74) *Attorney, Agent, or Firm*—Sughrue Mion, PLLC

(57) ABSTRACT

An ink jet recording apparatus has a recording head 22 having pressure chambers to which ink is supplied, pressure generation elements for generating pressure in the pressure chambers, and nozzle orifices 8 communicating with the pressure chambers for jetting ink drops, a cap 24 for sealing a nozzle face 40 of the recording head 22 while defining an internal space therein, and a suction pump for giving negative pressure to the internal space of the cap 24, and the cap 24 contains a cover member 33 for covering all nozzle orifices 8 with the cap 24 sealing the nozzle face 40, whereby bubbles occurring in the internal space of the cap 24 are prevented from adhering to the nozzle face 40 and entering the nozzle orifices 8 and a print failure is prevented from occurring.

20 Claims, 13 Drawing Sheets

INK JET RECORDING APPARATUS

BACKGROUND OF THE INVENTION

This invention relates to an ink jet recording apparatus for jetting ink drops from nozzle orifices, thereby recording images and characters on recording paper.

An ink jet recording apparatus using piezoelectric vibrators in a vertical vibration mode, which will be hereinafter referred to as recording head, generally comprises a channel unit 1 formed with a large number of nozzle orifices 8 and pressure chambers 7 and a head case 2 for housing piezoelectric vibrators 6, to which the channel unit 1 is attached, as shown in FIGS. 13 and 14.

The channel unit 1 comprises a nozzle plate 3 formed with rows of the nozzle orifices 8, a channel formation substrate 4 formed with rows of the pressure chambers 7 communicating with the nozzle orifices 8, and a vibration plate 5 for blocking lower openings of the pressure chambers 7, the nozzle plate 3, the channel formation substrate 4, and the vibration plate 5 being stacked on each other. The channel formation substrate 4 is formed with an ink reservoir 9 communicating with the pressure chambers 7 via an ink channel 10 for storing ink introduced into the pressure chambers 7.

The head case 2 has a space 12 penetrated up and down for housing the piezoelectric vibrators 6. Each piezoelectric vibrator 6 has a rear end side fixedly secured to a fix board 11 attached to the head case 2 and a tip face fixedly secured to an island part SA on the lower face of the vibration plate 5. In FIG. 13, numeral 14 denotes a frame for protecting the nozzle plates 3, etc.

In the recording head, a drive signal generated by a drive circuit is input to the piezoelectric vibrator 6 via a flexible circuit board 13 for expanding and contracting the piezoelectric vibrator 6 in the longitudinal direction thereof for changing pressure in the pressure chamber 7, thereby jetting ink in the pressure chamber 7 as an ink drop through the nozzle orifice 8.

In an ink jet recording apparatus using the recording head as described above, if print data runs out and the recording head itself is placed in a pause state, ink in the vicinity of the nozzle orifices 8 dries and the nozzle orifices are clogged. Thus, while the print operation is not performed, the recording head is sealed with a cap. However, if the recording head is left sealed with the cap for a long term, the solvent of ink in the proximity of the nozzle orifices 8 is volatilized little by little, the viscosity is increased, and trouble of making it impossible to print at once, degrading the print quality, etc., occurs easily. Further, new ink is supplied in sequence to the nozzle orifices 8 jetting ink drops consecutively by the print operation and the nozzle orifices 8 are hard to be clogged, but the nozzle orifices 8 positioned at the top end, the bottom end, etc., and having an extremely low opportunity of jetting ink drops are easily clogged because ink in the vicinity of the nozzle orifices 8 dries and the viscosity is increased during printing.

To deal with such a problem, as preliminary operation, etc., before print starts, when the recording apparatus is powered on or a print signal is first input, negative pressure is given to each nozzle orifice 8 by a suction pump, whereby ink is forcibly sucked from the nozzle orifices 8, whereby clogging of the nozzle orifices 8 is resolved and the jetting capability of ink is recovered as "cleaning operation."

To perform the cleaning operation, as shown in FIG. 15A, first the margin of a cap 15 shaped like a shallow box opened to the top is abutted against a nozzle face 40 on the lower side of the nozzle plate 3 for sealing. Next, a pump 16 connected to a suction pipe 17 is actuated with a valve 19 of a leak pipe 18 closed for sucking the inside of the cap 15, whereby ink is forcibly sucked from the nozzle orifices 8.

In the recording apparatus, after the ink suction terminates, sucking of the pump 16 is continued with the valve 19 of the leak pipe 18 opened for leaking the inside of the cap 15 and ink accumulating in the cap 15 is discharged. However, in the recording apparatus, when ink in the cap 15 is discharged, air enters the cap 15 from the leak pipe 18 and, bubbles 20 occur in a large amount in the cap 15 as shown in FIG. 15B. The bubbles 20 are deposited on the nozzle face or a back-flow of ink is produced by the action of negative pressure occurring in the recording head or an ink cartridge and the bubbles 20 enter the nozzle orifices 8 and a print failure such that ink drops are not jetted or that the ink drop jetting direction becomes unstable may occur in later print.

SUMMARY OF THE INVENTION

It is therefore an object of the invention to provide an ink jet recording apparatus for making it possible to preventing bubbles occurring in a cap after cleaning from adhering to a nozzle face, etc., and stabilize the printing operation.

In order to achieve the above object, according to the present invention, there is provided an ink jet recording apparatus comprising:

- a recording head including a pressure chamber to which ink is supplied, a nozzle face provided with a nozzle orifice communicated with the pressure chamber, and an element for generating pressure in the pressure chamber to eject an ink drop from the nozzle orifice;
- a cap member for sealing the nozzle face while defining an internal space therein;
- a cover member provided in the internal space of the cap member;
- a suction member for giving negative pressure to the internal space of the cap member; and
- a protrusion formed on the cover member at a portion opposing to the nozzle orifice, so as to face the nozzle face while defining a narrow gap therebetween to cover the nozzle orifice when the cap member seals the nozzle face.

In this configuration, if bubbles occur in the internal space of the cap member at the time of nozzle maintenance such as a cleaning operation, the nozzle orifice is covered by the cover member with the narrow gap in between and thus entering bubbles in the nozzle orifice is almost eliminated. Since ink in the cap member is prevented from back flowing into the nozzle orifice, mixing of inks when a plurality of inks are used is prevented.

Furthermore, since ink is held by the surface tension of liquid sandwiched between the cover member and the nozzle face, so that deposition of bubbles occurring when ink is discharged onto the nozzle face can be effectively prevented without destroying meniscuses. In addition, a jet failure caused by drying the recording head is also decreased. Therefore, a print failure such that ink drops are not jetted or that the ink drop jetting direction becomes unstable is hard to occur in later print.

Preferably, a gap is defined between the cap member and the cover member. An opening is formed within the gap so as to communicate with the suction member.

In this configuration, since the ink is sucked from the opening in the gap while retaining the ink in the nozzle orifice by the cover member when the cleaning operation is performed, a jet failure during the cleaning operation can be avoided by the simple configuration.

Preferably, a top face of a peripheral margin portion of the cap member is higher than a top face of the protrusion.

Preferably, the cover member is provided with a first abutment protrusion which. is to be abutted against the nozzle face to define a gap between the cover member and the nozzle face. The first abutment protrusion is continuously formed so as to surround the protrusion.

The first abutment protrusion may be continuously formed so as to surround the cover member. Here, a second abutment protrusion is formed on a portion surrounded by the first abutment protrusion.

In the above configurations, the ink surface area exposed to the atmosphere is lessened with the cover member covering nozzle orifice with the narrow gap between and, for example, to cover the nozzle orifice with the cover member while the recording apparatus stops, volatilization of ink solvent from the nozzle orifice can be decreased and occurrence of clogging can be prevented. Since the amount of ink held in the gap between the cover member and the nozzle face is lessened with the cover member covering the nozzle orifice with the narrow gap between, deposition of ink onto the nozzle face is lessened and removal of ink on the nozzle face by wiping, etc., is facilitated.

Preferably, the cover member covers the nozzle orifice during quiescent time of the apparatus.

In this configuration, volatilization of ink solvent from the nozzle orifice can be decreased drastically and occurrence of clogging can be decreased remarkably.

Preferably, the cover member is brought into intimate contact with the nozzle face to cover the nozzle orifice.

In this configuration, the hermeticity of the nozzle orifice by the cover member is enhanced and entering bubbles in the nozzle orifice can be prevented effectively.

Preferably, the cover member is made of a material having a stiffness not greater than a stiffness of a material composing the cap member, for example, an elastic material.

In this configuration, the hermeticity of the nozzle orifice by the cover member is enhanced and entering bubbles in the nozzle orifice and back-flow of ink can be prevented more effectively.

Preferably, a face of the cover member to be abutted against the nozzle face includes an inclined face.

In this configuration, the cover member abuts against the nozzle face gradually from the nearest portion of the inclined face to the nozzle face and thus sandwiching ink and bubbles between the nozzle face and the cover member is almost eliminated and back-flow of ink into the nozzle orifice and entering bubbles in the nozzle orifice can be prevented effectively.

Preferably, the suction member gives the negative pressure when the cover member defines the predetermined narrow gap.

In this configuration, ink sucking from the nozzle orifice and ink discharging from the cap member can be executed with the cover member and the cap member held in the same state, so that the structure and control of the: cap member and the cover member can be simplified.

Preferably, a face of the cover member to be abutted against the nozzle face is configured to be a hydrophilic surface.

In this configuration, ink is effectively held between the cover member and the nozzle orifice, so that the adverse effect of destroying meniscuses, etc., is lessened.

Preferably, an inner face of the cap member defining the internal space is configured to be a hydrofuge surface except for the hydrophilic surface.

In this configuration, after ink in the cap member is discharged, ink in the cap member becomes hard to remain.

Preferably, the cover member and the cap member are provided as an integral member.

In this configuration, the structure is comparatively simple and is advantageous in costs and ink leakage, etc., is also hard to occur.

BRIEF DESCRIPTION OF THE DRAWINGS

In the accompanying drawings:

FIG. 2A is a sectional view in nozzle row direction; FIG. 2B is a plan view of a cap; and FIG. 2C is a sectional view in a direction perpendicular to nozzle rows;

FIG. 6A shows a state in which a cap seals a nozzle face and FIG. 6B shows a state in which a cover member covers nozzle orifices;

FIG. 7A shows a state in which a cap seals a nozzle face and FIG. 7B shows a state in which a cover member covers nozzle orifices;

FIG. 8A is a sectional view in nozzle row direction; FIG. 8B is a plan view of a cap; and FIG. 8C is a sectional view in a direction perpendicular to nozzle rows;

FIG. 10A is a sectional view in nozzle row direction; FIG. 10B is a plan view of a cap; and FIG. 10C is a sectional view in a direction perpendicular to nozzle rows;

FIG. 11A is a sectional view in nozzle row direction; FIG. 11B is a plan view of a cap; and FIG. 11C is a sectional view in a direction perpendicular to nozzle rows;

FIG. 12A is a sectional view in nozzle row direction; FIG. 12B is a plan view of a cap; and FIG. 12C is a sectional view in a direction perpendicular to nozzle rows;

FIG. 15A shows a state in which ink in recording head is sucked and FIG. 15B shows a state in which ink in a cap is discharged.

DETAILED DESCRIPTION OF THE PREFERRED EMBODIMENTS

Referring now to the accompanying drawings, there are shown preferred embodiments of the invention.

Figure 1:
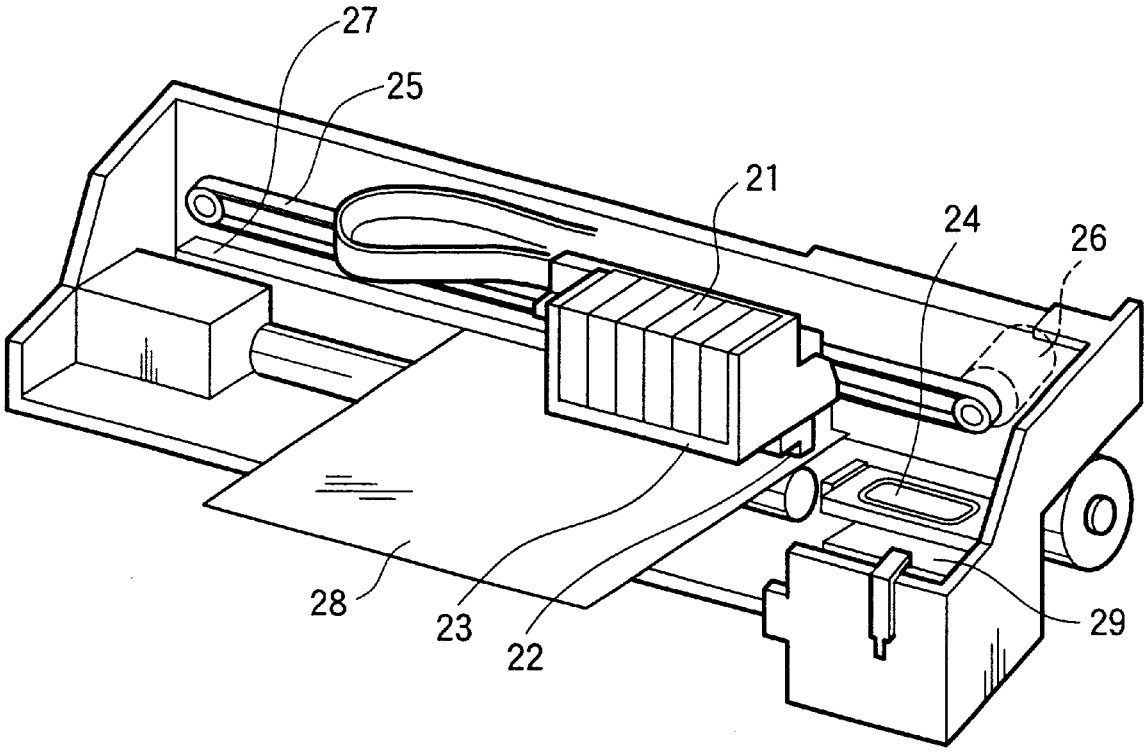
FIG. 1 is a perspective view to describe the peripheral structure of an ink jet recording apparatus incorporating the invention.
Figure 13:
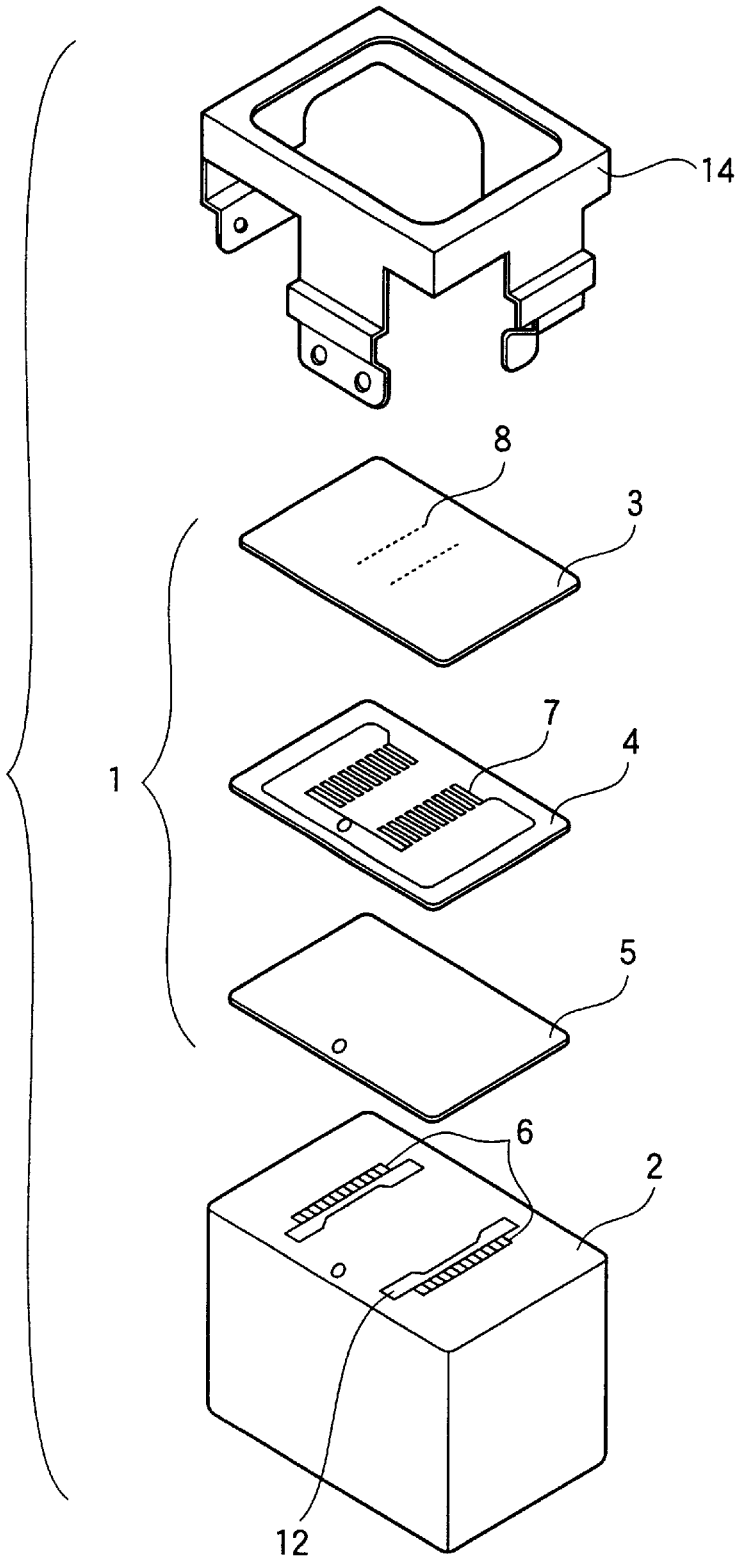
FIG. 13 is an exploded perspective view to show an ink jet recording head.
Figure 14:
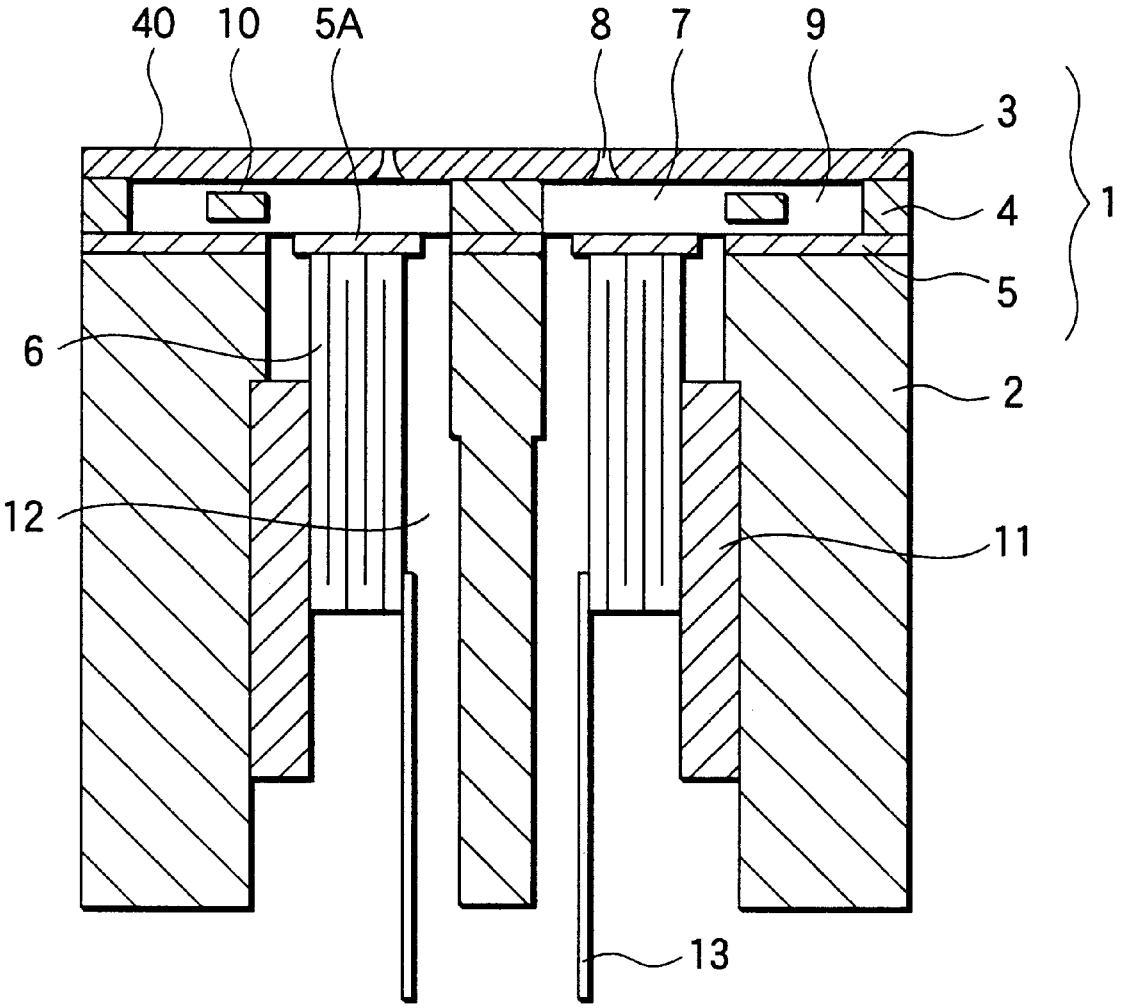
FIG. 14 is a sectional view to show the ink jet recording head in FIG. 13.
Figure 15A:
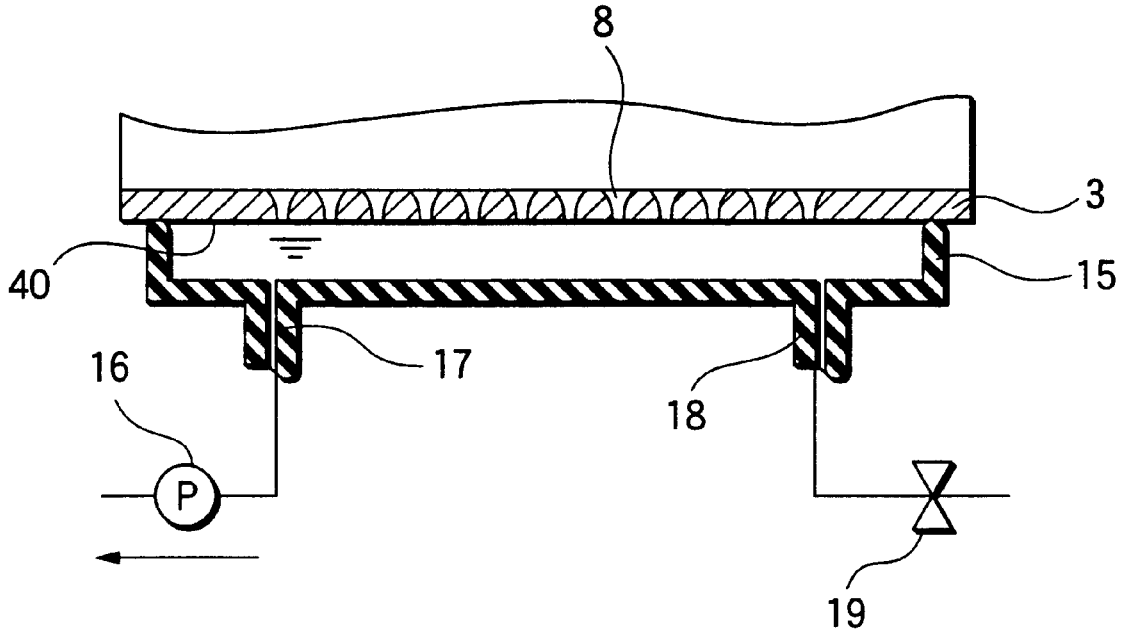
FIGS. 15A and 15B are drawings to describe the action of a related ink jet recording apparatus.
Figure 15B:
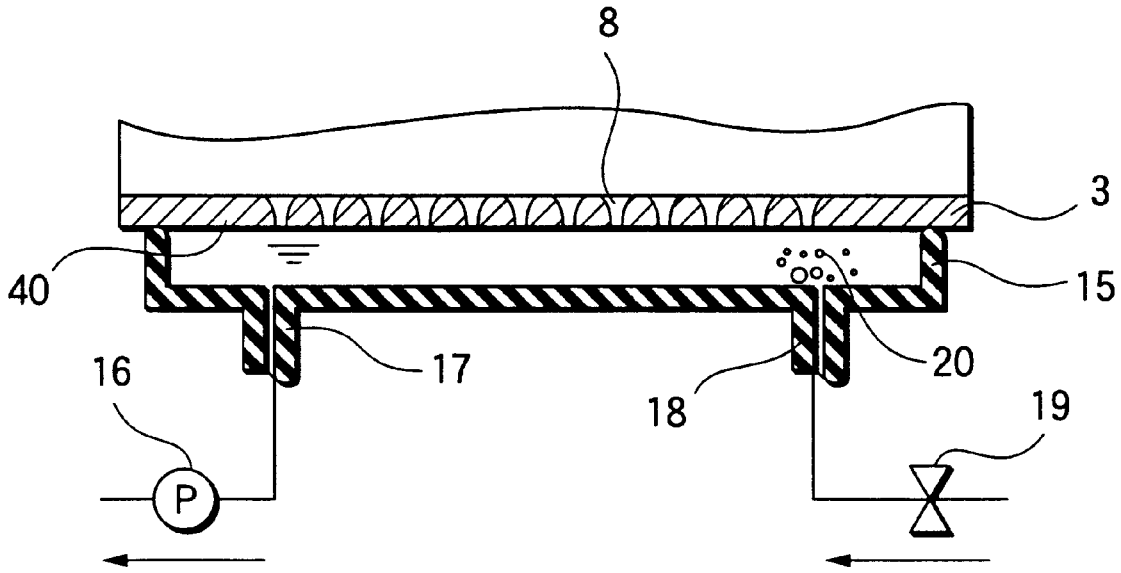

FIG. 1 is a drawing to show an example of the peripheral structure of an ink jet recording apparatus incorporating the invention. The recording apparatus comprises a carriage 23 with an ink cartridge 21 mounted on the top and a recording head 22 attached to the lower face and a cap 24 for sealing the recording head 22, etc. The recording head 22 is basically similar to the recording head shown in FIGS. 13 and 14 and parts similar to those previously described with reference to FIGS. 13 and 14 are denoted by the same reference numerals in the description that follows.

The carriage 23 is connected to a stepping motor 26 via a timing belt a 25 and is guided by a guide bar 27 and is reciprocated in the paper width direction of recording paper 28. The recording head 22 is attached to the face of the carriage 23 opposed to the recording paper 28 (in the example, lower face). Ink is supplied to the recording head 22 from the ink cartridge 21 and while the carriage 23 is moved, ink drops are jetted onto the face of the recording paper 28 for printing images and characters on the recording paper 28 according to a dot matrix.

The cap 24 is placed in a non-print area in the move range of the carriage 23 and seals a nozzle face 40 of the recording head 22 during quiescent print, thereby preventing nozzle orifices 8 from drying as much as possible. The cap 24 is connected to a suction pump 29 and gives negative pressure to the nozzle orifices 8 of the recording head 22 during the cleaning operation for sucking ink from the nozzle orifices 8. Further, the cap 24 may function as a vessel for receiving ink drops jetted from the recording head 22 by the flushing operation.

Figure 2A:
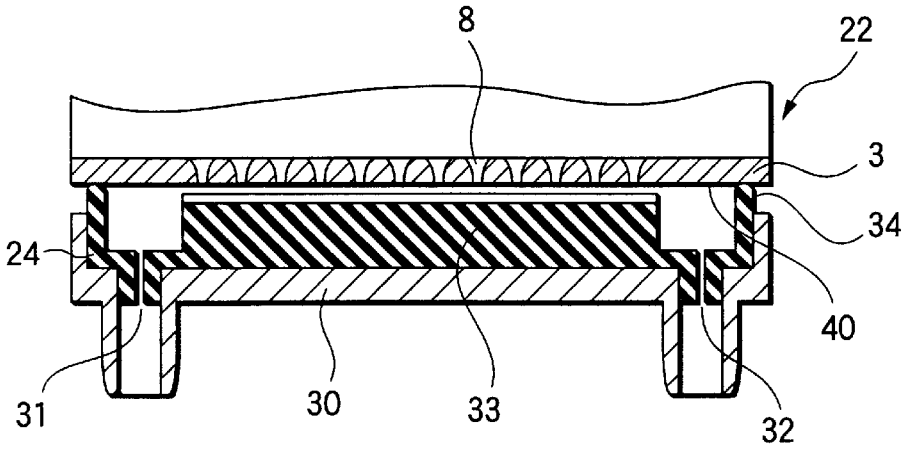
FIGS. 2A to 2C are drawings to show the main parts of the ink jet recording apparatus according to a first embodiment of the invention.
Figure 2B:
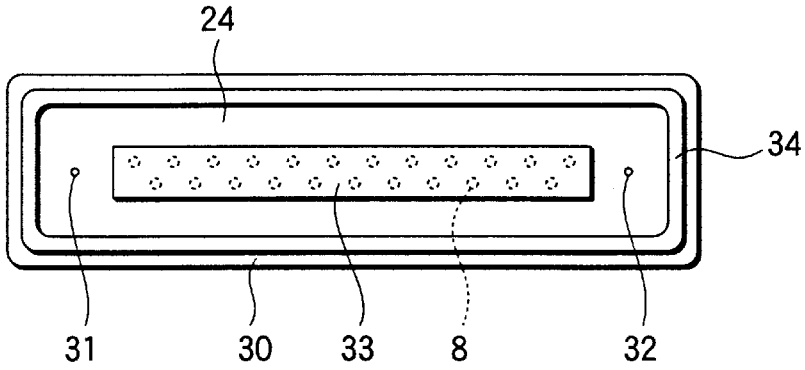
Figure 2C:
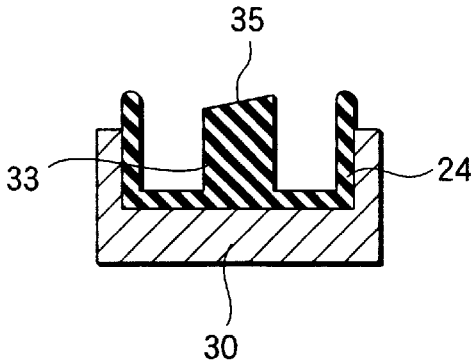

The cap 24 will be discussed in more detail. As shown in FIG. 2, the cap 24 is shaped like a shallow box having an opening on the top and shows a rectangle covering almost the whole of the lower face of a nozzle plate 3 (nozzle face 40) on a plan view. A peripheral margin portion 34 of the upper opening is abutted against the nozzle face 40, whereby the nozzle face 40 is sealed with the cap 24 with the internal space thereof between.

The cap 24 is formed with a suction hole 31 communicating with a suction pump 29 for giving negative pressure to the internal space of the cap 24. It is also formed with a leak hole 32 communicating with a leak valve (not shown) for allowing air to be introduced into the internal space of the cap 24 as the leak valve is opened/closed.

The cap 24 is formed on the bottom with a cover member 33 for covering all nozzle orifices 8 with the cap 24 sealing the nozzle face 40. The cover member 33 and the cap 24 are made of elastic material such as rubber and are formed in one piece. A crest 35 of the cover member 33 is formed as a gentle slope face. Further, the cap 24 is held in a cap holder 30 moving up and down.

According to the configuration, for example, the cleaning operation is performed as follows: First, to perform cleaning, the carriage 23 is moved to the position of the cap 24 and the cap 24 and the nozzle face 40 are opposed to each other and the cap holder 30 is moved up, whereby the peripheral margin portion 34 of the cap 24 is abutted against the nozzle face 40 and the nozzle face 40 of the recording head 22 is sealed with the cap 24 (see FIG. 2A).

In this state, the leak valve made to communicate with the leak hole 32 is closed and the space in the cap 24 is sucked by the suction pump 29 made to communicate with the suction hole 31, whereby negative pressure is given to the nozzle orifices 8 and ink in pressure chambers 7 is sucked forcibly.

Figure 3:
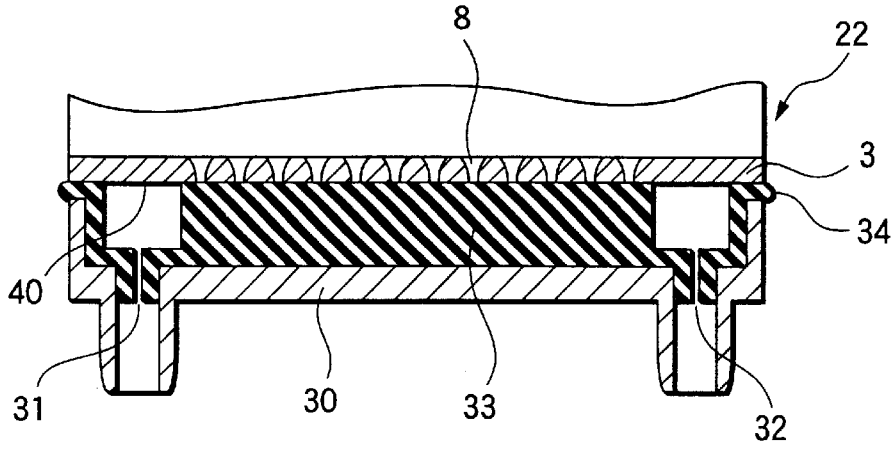
FIG. 3 is a sectional view to show the operation of the ink jet recording apparatus.

Next, as shown in FIG. 3, the cap holder 30 is further moved up, the peripheral margin portion 34 of the cap 24 is deformed, and the crest 35 of the cover member 33 is brought into intimate contact with the nozzle face 40 for blocking all nozzle orifices 8. At this time, the cover member 33 is made of elastic material and thus the hermeticity of the nozzle orifices 8 by the cover member 33 is enhanced.

At this time, while sucking of the suction pump 29 is executed, the cap holder 30 is moved up and the cover member 33 is pressed, whereby ink can be prevented from back flowing into the nozzle orifices 8 by pressure generated when the cover member 33 blocks the nozzle orifices 8.

Further, at this time, since the crest 35 of the cover member 33 is formed as a slope face, the cover member 33 is pressed against the nozzle face 40 gradually from the nearest portion of the slope face to the nozzle face 40 and thus sandwiching ink and bubbles between the nozzle face 40 and the cover member 33 is almost eliminated and back-flow of ink into the nozzle orifices 8 and entering bubbles in the nozzle orifices 8 can be prevented.

The leak valve communicating with the leak hole 32 is opened and sucking of the suction pump 29 is executed with the cover member 33 blocking the nozzle orifices 8, whereby ink accumulating in the cap 24 is discharged. After this, the cap holder 30 is moved down and wiping out of the nozzle face 40 with a wiper and the flushing operation of giving a drive signal to piezoelectric vibrators 6 independently of a print signal for jetting ink drops are performed as required, then print operation is executed.

Next, after the print operation terminates, the carriage 23 is moved to the position of the cap 24, the cap holder 30 is moved up, the nozzle face 40 is sealed with the cap 24, and all nozzle orifices 8 are blocked by the cover member 33, then the recording apparatus is stopped. The nozzle orifices 8 are thus covered with the cover member 33 while the recording apparatus stops, whereby volatilization of ink from the nozzle orifices while the recording apparatus stops can be decreased drastically and occurrence of clogging can be reduced remarkably.

In the recording apparatus, when ink in the cap 24 is discharged, the nozzle orifices 8 are covered with the cover member 33, so that bubbles occurring in the cap 24 when ink is discharged are hard to adhere to the nozzle face 40 and bubbles become hard to enter the nozzle orifices 8. Therefore, a print failure such that ink drops are not jetted or that the ink drop jetting direction becomes unstable is hard to occur in later print, and color mixing of ink, etc., in the recording apparatus using a plurality of color inks is prevented.

Since the cap 24 and the cover member 33 seal the nozzle face 40 for blocking the nozzle orifices 8 by the abutment force against the nozzle face 40 as the cap holder 30 is moved up, the comparatively simple mechanism can seal the nozzle face 40 for blocking the nozzle orifices 8 effectively. Further, the cover member 33 and the cap 24 are formed in one piece and thus ink leakage, etc., is also hard to occur in comparatively simple structure.

Since the recording head 22 using the piezoelectric vibrators 6 as described above is easily adversely affected by entry of bubbles in the nozzle orifices 8, the advantage of preventing bubbles from entering the nozzle orifices 8 is noticeable.

Figure 4:
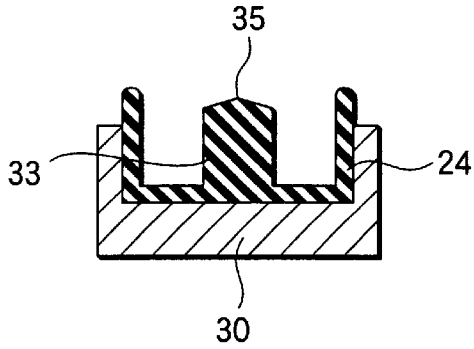
FIG. 4 is a sectional view to show a cap used with an ink jet recording apparatus according to a second embodiment of the invention.

FIG. 4 is a drawing to show a second embodiment of an ink jet recording apparatus of the invention. The recording apparatus is the same as that shown in FIGS. 1 and 2 except that a crest 35 of a cover member 33 has two slop faces. Parts similar to those previously described with reference to FIGS. 1 and 2 are denoted by the same reference numerals in FIG. 4. The recording apparatus also provides similar advantages to those of the recording apparatus shown in FIGS. 1 and 2.

Figure 5:
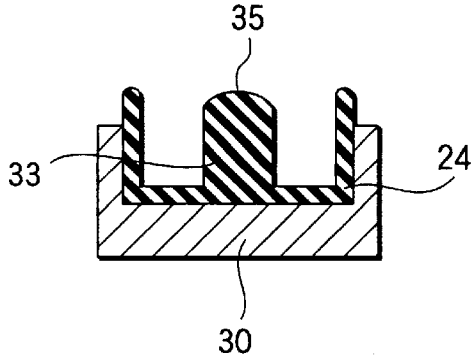
FIG. 5 is a sectional view to show a cap used with an ink jet recording apparatus according to a third embodiment of the invention.

FIG. 5 is a drawing to show a third embodiment of an ink jet recording apparatus of the invention. The recording apparatus is the same as that shown in FIGS. 1 and 2 except that a crest 35 of a cover member 33 is formed like a convex face rather than a slope face. Parts similar to those previously described with reference to FIGS. 1 and 2 are denoted by the same reference numerals in FIG. 5. The recording apparatus also provides similar advantages to those of the recording apparatus shown in FIGS. 1 and 2.

Figure 6A:
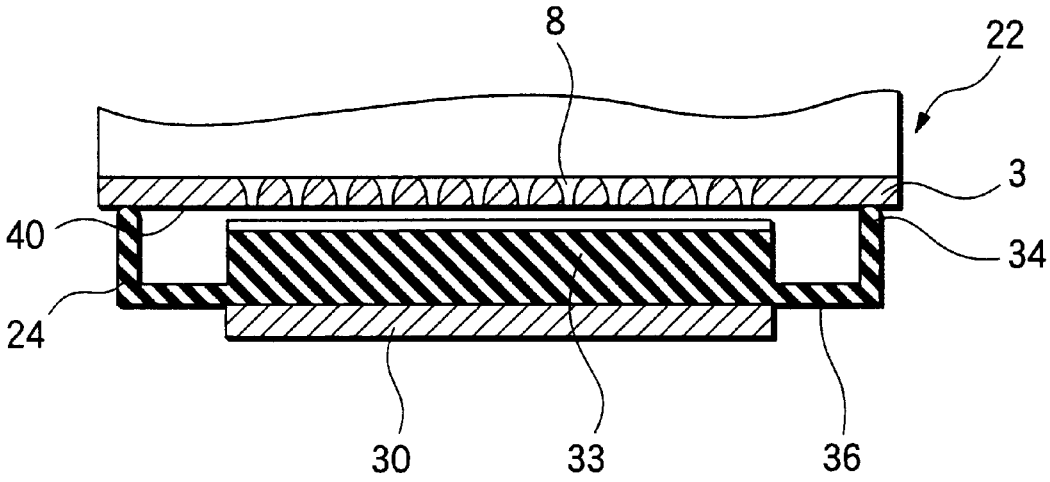
FIGS. 6A and 6B are sectional views to show the function of an ink jet recording apparatus according to a fourth embodiment of the invention.
Figure 6B:
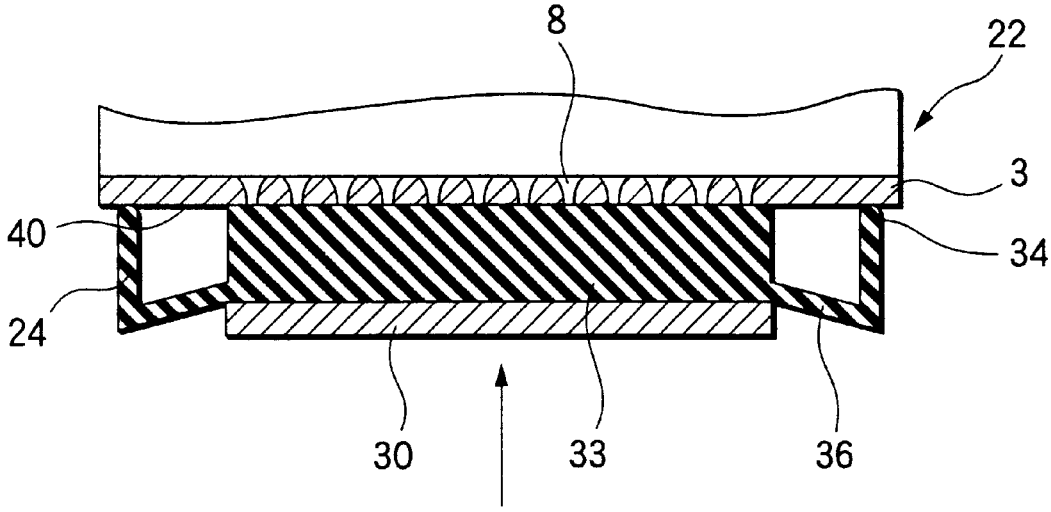

FIGS. 6A and 6B are drawings to show a fourth embodiment of an ink jet recording apparatus of the invention. In the recording apparatus, a cap holder 30 does not hold the whole of a cap 24 and holds the bottom center part of the cap 24. The cap holder 30 is moved up with a peripheral margin portion 34 of the cap 24 abutting a nozzle face 40, whereby a bottom part 36 of the cap 24 becomes deformed and a cover member 33 blocks nozzle orifices 8. A suction hole 31 and a leak hole 32 are not shown. Other parts are similar to those previously described with reference to FIGS. 1 and 2 and are denoted by the same reference numerals in FIG. 6. The recording apparatus also provides similar advantages to those of the recording apparatus shown in FIGS. 1 and 2.

Figure 7A:
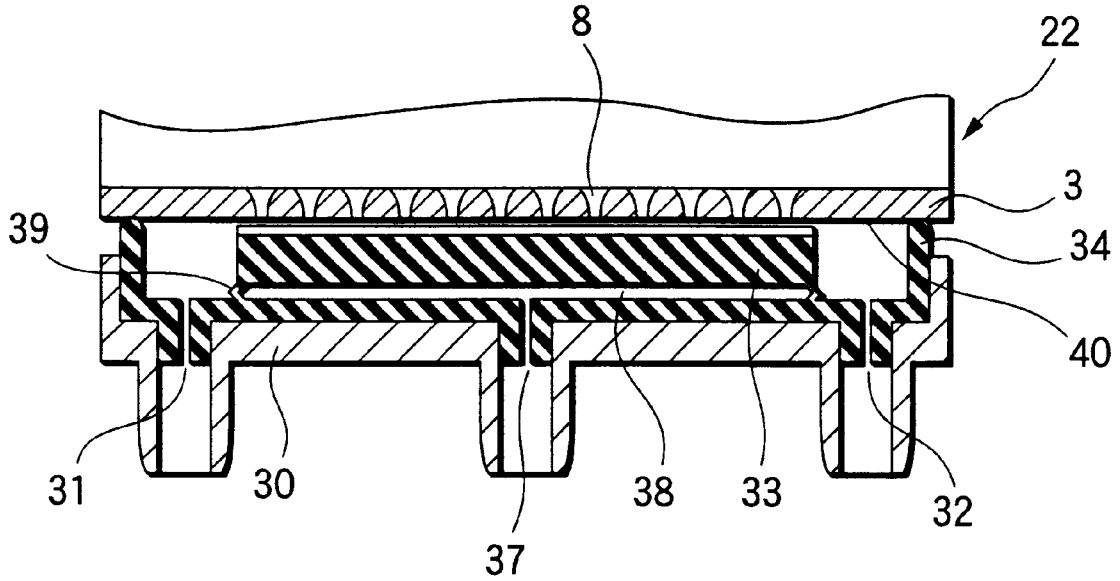
FIGS. 7A and 7B are sectional views to show the function of an ink jet recording apparatus according to a fifth embodiment of the invention.
Figure 7B:
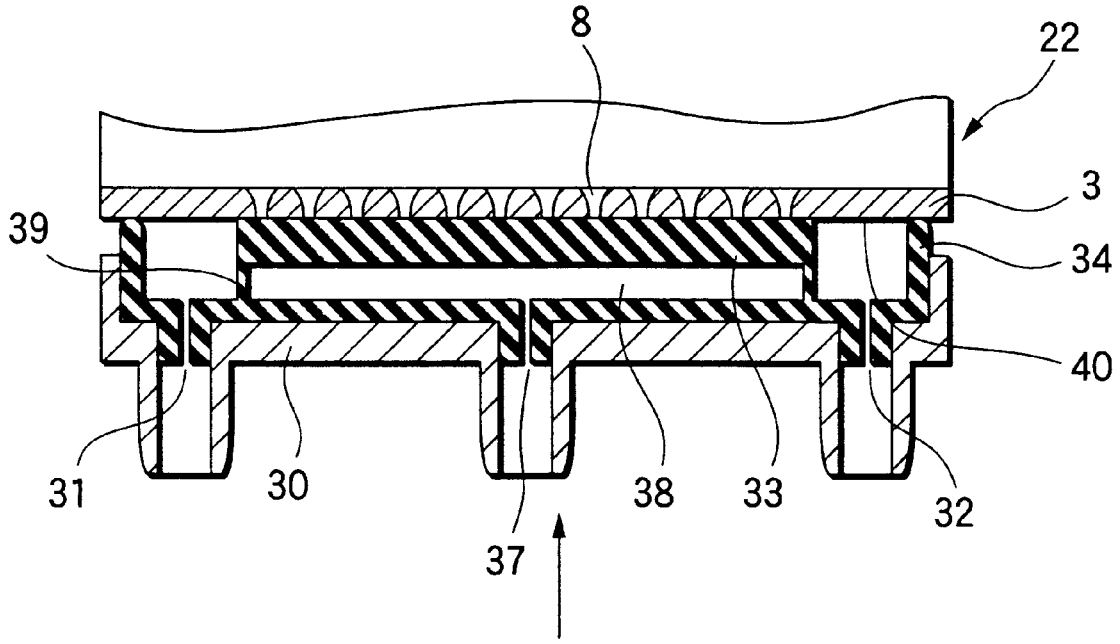

FIGS. 7A and 7B are drawings to show a fifth embodiment of an ink jet recording apparatus of the invention. In the recording apparatus, a peripheral margin portion of a cover member 33 is joined to the bottom part of a cap 24 via a thin hinge 39 and an actuation space 38 expanded as air is introduced into a gap between the cover member 33 and the cap 24 is formed. Numeral 37 denotes an air in take hole for introducing air into the actuation space 38.

In the recording apparatus, air is introduced into the actuation space 38 with a peripheral margin portion 34 of the cap 24 abutting a nozzle face 40 and the thin hinge 39 is extended by air pressure and the actuation space 38 is expanded, whereby the cover member 33 is pushed upward and is pressed against the nozzle face 40 for blocking nozzle orifices 8 by the abutment force. Other parts are similar to those previously described with reference to FIGS. 1 and 2 and are denoted by the same reference numerals in FIG. 7. The recording apparatus also provides similar advantages to those of the recording apparatus shown in FIGS. 1 and 2.

Figure 8A:
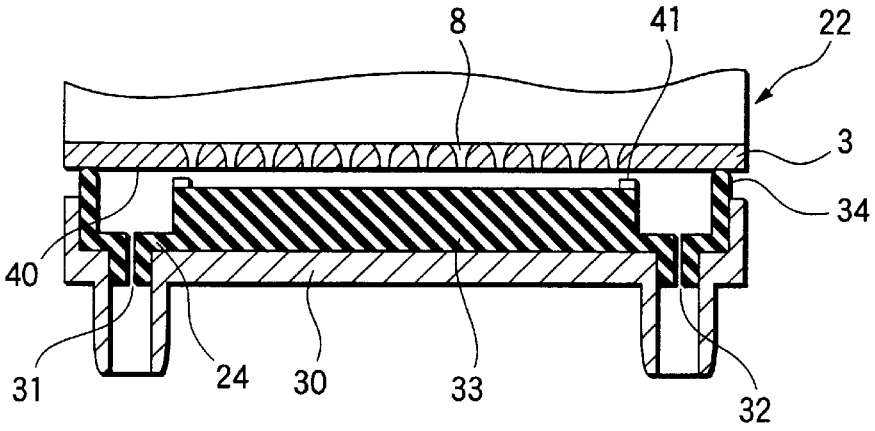
FIGS. 8A to 8C are drawings to show the main parts of an ink jet recording apparatus according to a sixth embodiment of the invention.
Figure 8B:
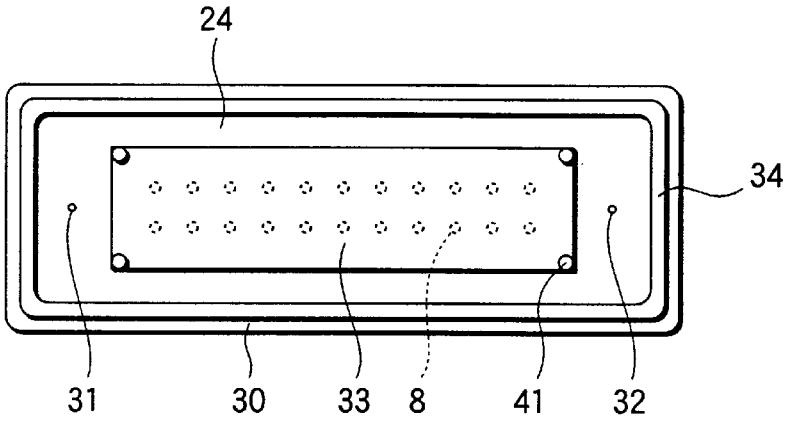
Figure 8C:
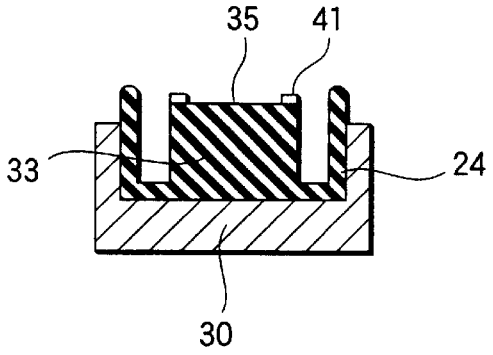

FIGS. 8A to 8C are drawings to show a sixth embodiment of an ink jet recording apparatus of the invention. In the recording apparatus, a crest 35 of a cover member 33 is formed on a plane parallel with a nozzle face 40 and an abutment projection 41 for abutting the nozzle face 40 in a state in which the cover member 33 faces the nozzle face 40 with a narrow gap 42 between is provided at four corners of the crest 35. Other parts are similar to those previously described with reference to FIGS. 1 and 2 and are denoted by the same reference numerals in FIG. 8.

To perform the cleaning operation in the recording apparatus, first a carriage 23 is moved to the position of a cap 24 and the cap 24 and the nozzle face 40 are opposed to each other and a cap holder 30 is moved up, whereby a peripheral margin portion 34 of the cap 24 is abutted against the nozzle face 40 and the nozzle face 40 of a recording head 22 is sealed with the cap 24 (see FIG. 8A).

In this state, the leak valve made to communicate with a leak hole 32 is closed and the space in the cap 24 is sucked by a suction pump 29 made to communicate with a suction hole 31, whereby negative pressure is given to nozzle orifices 8 and ink in pressure chambers 7 is sucked forcibly.

Figure 9:
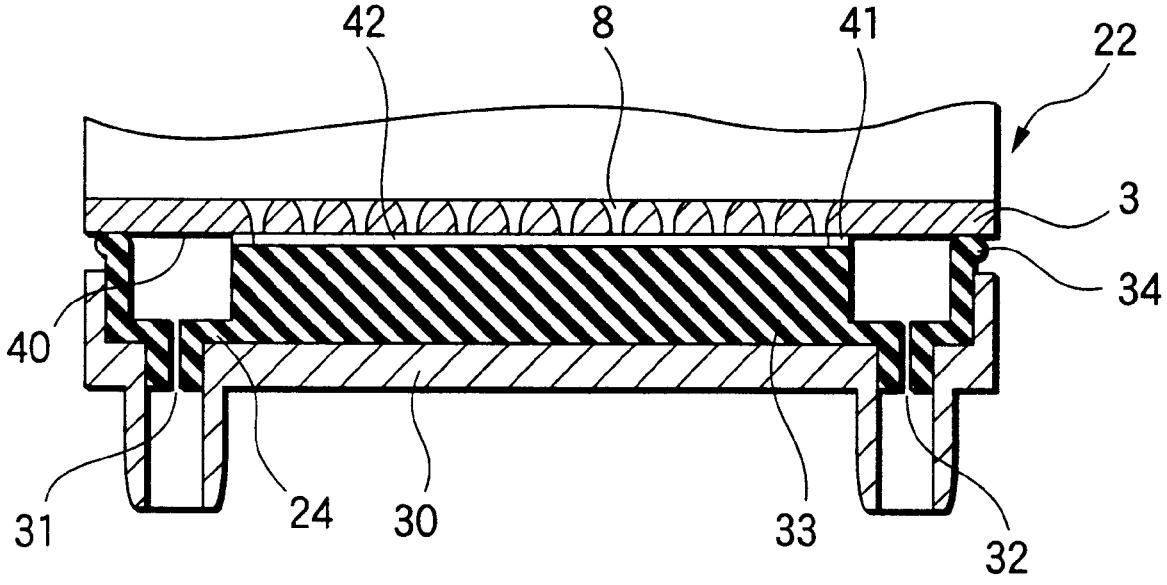
FIG. 9 is a sectional view to show the function of the ink jet recording apparatus shown in FIGS. 8A to 8C.

Next, as shown in FIG. 9, the cap holder 30 is further moved up, the peripheral margin portion 34 of the cap 24 is deformed, the cover member 33 is moved up, the abutment projections 41 formed on the crest 35 is abutted against the nozzle face 40, and the cover member 33 is made to face the nozzle face 40 with the narrow gap 42 between for covering all nozzle orifices 8.

The leak valve communicating with the leak hole 32 is opened and sucking of the suction pump 29 is executed with the cover member 33 blocking the nozzle orifices 8, whereby ink accumulating in the cap 24 is discharged. After this, the cap holder 30 is moved down and wiping out of the nozzle face 40 with a wiper and the flushing operation of giving a drive signal to piezoelectric vibrators 6 independently of a print signal for jetting ink drops are performed as required, then print operation is executed.

Next, after the print operation terminates, the carriage 23 is moved to the position of the cap 24, the cap holder 30 is moved up, the nozzle face 40 is sealed with the cap 24, and the cover member 33 is made to face the nozzle face 40 with the narrow gap 42 between for covering all nozzle orifices 8. In this state, the recording apparatus is stopped.

According to the recording apparatus, the cover member 33 is not pressed again the nozzle face 40 and thus ink can be prevented from back flowing into the nozzle orifices 8. If bubbles are sandwiched between the cover member 33 and the nozzle face 40, the bubbles are hard to enter the nozzle orifices 8 and occurrence of a jet failure caused by entry of the bubbles can be prevented. Further, when the cover member 33 is taken off the nozzle face 40, the cover member 33 is not in intimate contact with the nozzle face 40 and thus rapid negative pressure is hard to occur in the nozzle orifices 8 and when the cover member 33 is removed, destroying a meniscus in each nozzle orifice is almost eliminated and unstable jetting caused by destroying a meniscus can be prevented.

Since the crest 35 of the cover member 33 and the nozzle face 40 are roughly parallel with each other, ink can be stably held in the narrow gap 42 by the capillary force of ink. Moreover, the abutment projection 41 of the cover member 33 is simply abutted against the nozzle face 40, whereby the nozzle face 40 and the cover member 33 can be held in the predetermined narrow gap 42 and easy control can be accomplished. In addition, the recording apparatus shown in FIGS. 1 and 2.

In the above-described embodiments, ink is sucked from the nozzle orifices 8 with the cover member 33 not covering the nozzle orifices 8 and ink in the cap 24 is discharged with the cover member 33 covering the nozzle orifices 8 with the narrow gap 42 between, but sucking of the suction pump 29 may be executed with the cover member 33 covering the nozzle orifices 8 with the narrow gap 42 between (see FIG. 9). In doing so, sucking of the suction pump 29 and discharging ink in the cap 24 can be executed with the cover member 33 and the cap 24 held in the same state, so that the structure and control of the cap 24 and the cover member 33 can be simplified.

In the above-described embodiments, the dimensions of the narrow gap 42 between the cover member 33 and the nozzle face 40 can be set appropriately depending on the characteristics of the viscosity, surface tension, etc., of ink used and are not limited; for example, to use ink having viscosity of about 3.60 to 4.02 mPas and surface tension of about 31.1 to 32.6 mN/m, the narrow gap 42 is set to about 0.2 mm or less, whereby ink can be held stably.

In the embodiment, the abutment projection is provided to forming the narrow gap between the nozzle face 40 and the cover member 33, but the invention is not limited to it; the means for forming the narrow gap 42 is not limited to the abutment projection.

In the above-described embodiments, it is desirable to form the cover member 33 of elastic member, but the cover member 33 is not limited to elastic member either and the elastic member can also be replaced with metal or plastic.

Figure 10A:
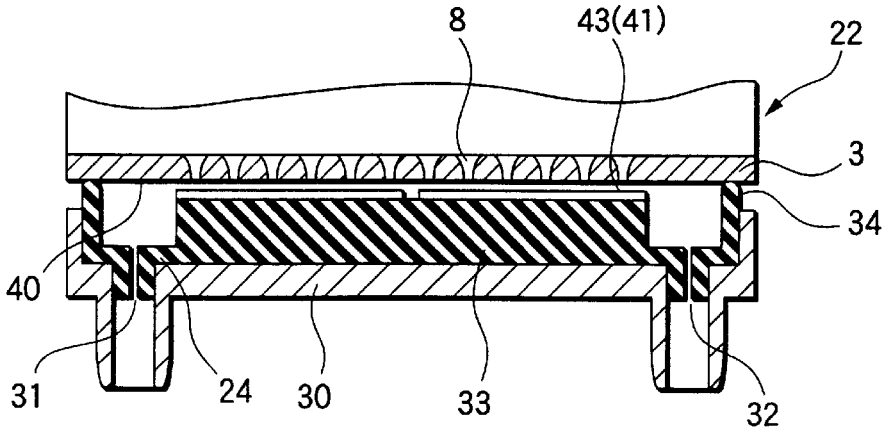
FIGS. 10A to 10C are drawings to show the main parts of an ink jet recording apparatus according to a seventh embodiment of the invention.
Figure 10B:
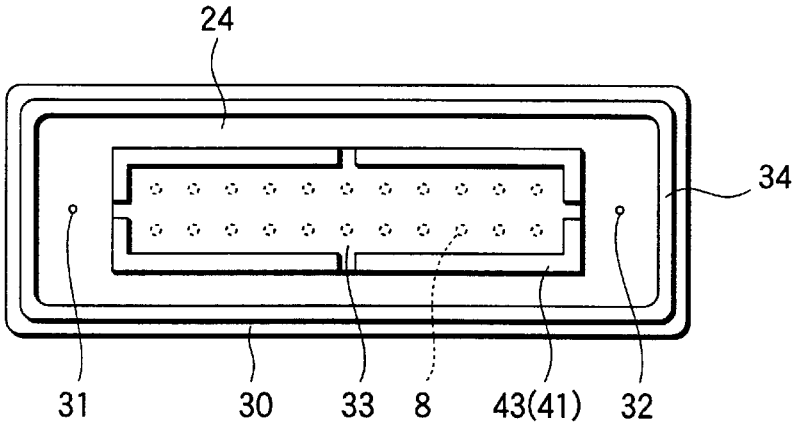
Figure 10C:
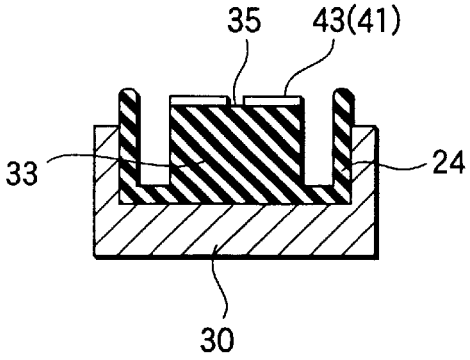

FIGS. 10A to 10C are drawings to show a seventh embodiment of an ink jet recording apparatus of the invention. The recording apparatus is the same as that shown in FIGS. 8 and 9 except that abutment projections 41 formed on a crest 35 of a cover member 33 are placed on peripheral margins of the cover member 33 as projection ribs 43. Parts similar to those previously described with reference to FIGS. 8 and 9 are denoted by the same reference numerals in FIGS. 10A to 10C.

In the recording apparatus, the ink surface area exposed to the atmosphere is lessened with the cover member 33 covering nozzle orifices 8 with a narrow gap 42 between and to cover the nozzle orifices 8 with the cover member 33 while the recording apparatus stops, volatilization of ink solvent from the nozzle orifices 8 can be decreased and occurrence of clogging can be prevented. In addition, the recording apparatus also provides similar advantages to those of the recording apparatus shown in FIGS. 8 and 9.

Figure 11A:
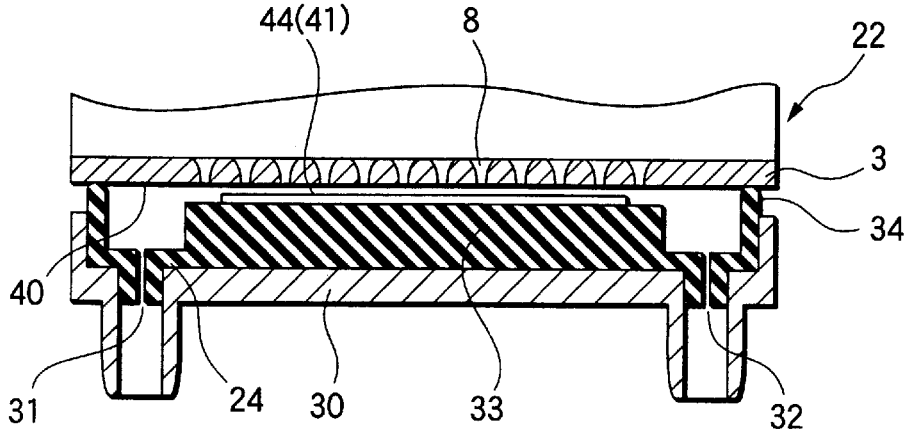
FIGS. 11A to 11C are drawings to show the main parts of an ink jet recording apparatus according to an eighth embodiment of the invention.
Figure 11B:
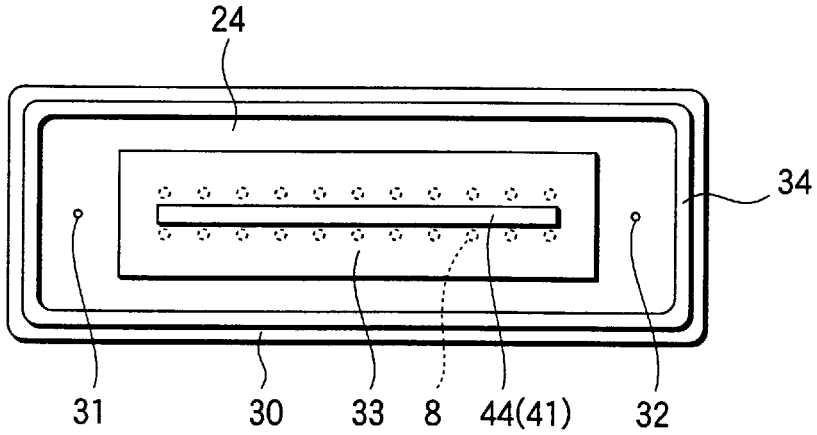
Figure 11C:
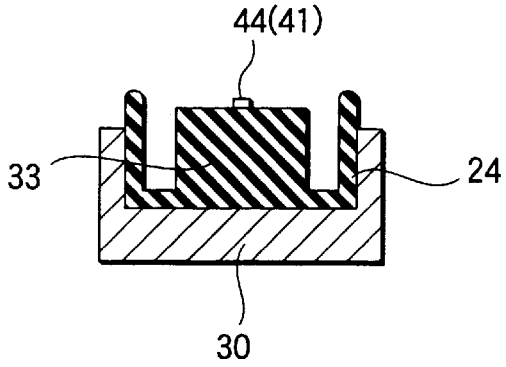

FIGS. 11A to 11C are drawings to show an eighth embodiment of an ink jet recording apparatus of the invention. The recording apparatus is the same as that shown in FIGS. 8 and 9 except that abutment projection 41 formed on a crest 35 of a cover member 33 is formed as a projection rib 44 between two rows of nozzle orifices 8. Parts similar to those previously described with reference to FIGS. 8 and 9 are denoted by the same reference numerals in FIGS. 11A to 11C.

The recording apparatus also provides similar advantages to those of the recording apparatus shown in FIGS. 8 and 9.

Figure 12A:
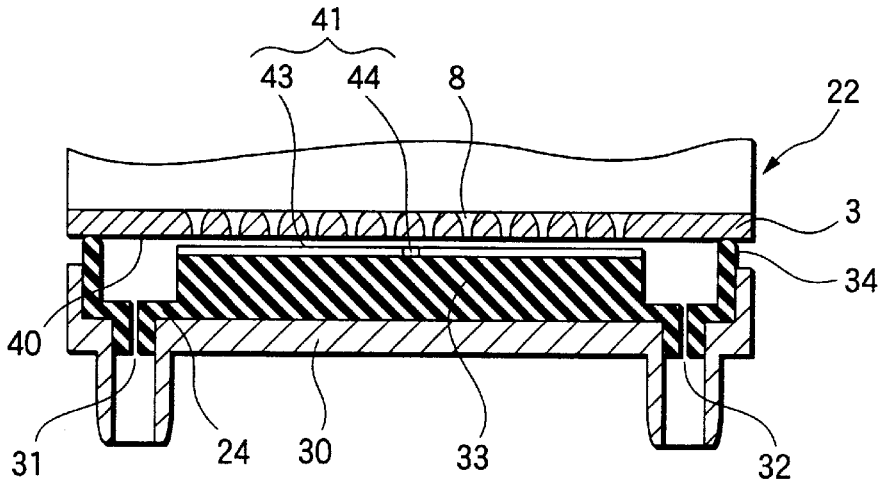
FIGS. 12A to 12C are drawings to show the main parts of an ink jet recording apparatus according to a ninth embodiment of the invention.
Figure 12B:
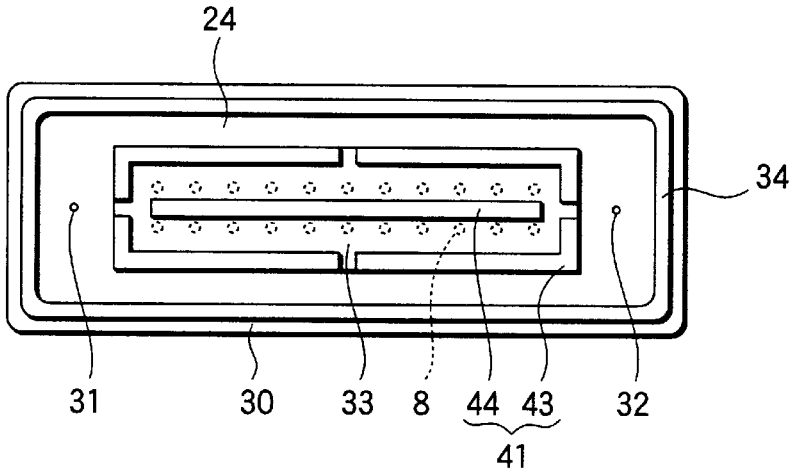
Figure 12C:
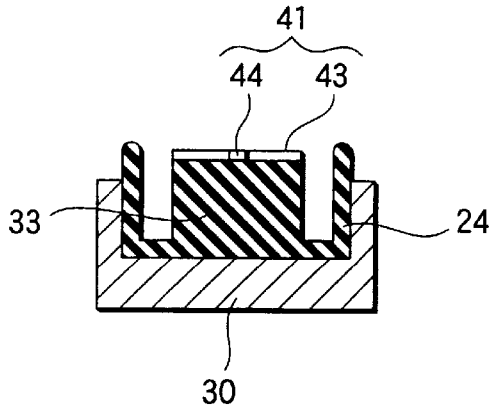

FIGS. 12A to 12C are drawings to show a ninth embodiment of an ink jet recording apparatus of the invention. The recording apparatus is the same as that shown in FIGS. 8 and 9 except that abutment projections 41 formed on a crest 35 of a cover member 33 are made up of projection ribs 43 placed on peripheral margins of the cover member 33 and a projection rib 44 formed between two rows of nozzle orifices 8 surrounded by the projections 43. Parts similar to those previously described with reference to FIGS. 8 and 9 are denoted by the same reference numerals in FIGS. 12A to 12C.

In the recording apparatus, the ink surface area exposed to the atmosphere is lessened with the cover member 33 covering nozzle orifices 8 with a narrow gap 42 between and, for example, to cover the nozzle orifices 8 with the cover member 33 while the recording apparatus stops, volatilization of ink solvent from the nozzle orifices 8 can be decreased and occurrence of clogging can be prevented. Since the amount of ink held in the gap between the cover member 33 and a nozzle face 40 is lessened with the cover member 33 covering the nozzle orifices 8 with the narrow gap 42 between, deposition of ink onto the nozzle face 40 is lessened and removal of ink on the nozzle face 40 by wiping, etc., is facilitated. In addition, the recording apparatus also provides similar advantages to those of the recording apparatus shown in FIGS. 8 and 9.

In the above-described embodiments, preferably the crest 35 of the cover member 33 facing the nozzle face 40 is made a hydrophilic surface and the inner faces of the cap 24 other than the crest 35 of the cover member 33 are made hydrophobic surfaces. The crest 35 is made a hydrophilic surface, whereby ink is effectively held between the cover member 33 and the nozzle orifices 8, so that the adverse effect of destroying meniscuses, etc., is lessened. The inner faces of the cap 24 other than the crest 35 are made hydrophobic surfaces, whereby after ink in the cap 24 is discharged, ink in the cap 24 becomes hard to remain.

In the above-described embodiments, the cover member 33 and the cap 24 are molded in one piece as an example, but the invention is not limited to it and the cover member 33 and the cap 24 may be formed in separate pieces and be combined into one piece with an adhesive, etc. In this case, similar advantages can also be provided. In the description of the embodiments, the invention is applied to the ink jet recording apparatus using the piezoelectric vibrators 6 in the vertical vibration mode as examples. However, the invention is not limited to them and may be applied to recording apparatus using piezoelectric vibrators in deflection vibration mode and can also be applied to an ink jet recording apparatus of so-called bubble jet type using a heating element for heating and evaporating ink in a channel as a pressure generating element.

As described above, according to the ink jet recording apparatus of the invention, since the nozzle orifices are covered with the cover member, if bubbles occur in the internal space of the cap member, the bubbles are hard to adhere to the nozzle face and scarcely enter the nozzle orifices and a print failure such that ink drops are not jetted or that the ink drop jetting direction becomes unstable is hard to occur in later print. Since ink in the cap member is prevented from back flowing into the nozzle orifices, mixing of inks when a plurality of inks are used is prevented.

What is claimed is:

1. An ink jet recording apparatus comprising:

a recording head including a pressure chamber to which ink is supplied, a nozzle face provided with a nozzle orifice communicated with the pressure chamber, and an element for generating pressure in the pressure chamber to eject an ink drop from the nozzle orifice;

a cap member for sealing the nozzle face while defining an internal space therein;

a cover member provided in the internal space of the cap member so as to face the nozzle face while defining a gap therebetween which generates a capillary force therein, when the cap member seals the nozzle face; and a suction member for giving negative pressure to the internal space of the cap member.

2. The ink jet recording apparatus as set forth in claim 1, wherein a gap is defined between the cap member and the cover member.

3. The ink jet recording apparatus as set forth in claim 1, wherein a top face of a peripheral margin portion of the cap member is higher than a top face of the protrusion.

4. The ink jet recording apparatus as set forth in claim 2, wherein an opening is formed within the gap so as to communicate with the suction member.

5. The ink jet recording apparatus as set forth in claim 1, wherein the cover member is provided with a first abutment protrusion which is abutted against the nozzle face when the cap member seals the nozzle face.

6. The ink jet recording apparatus as set forth in claim 5, wherein the cover member is provided with a protrusion which faces the nozzle face while defining a gap therebetween to cover the nozzle orifice when the cap member seals the nozzle face; and wherein the first abutment protrusion is formed so as to surround the protrusion.

7. The ink jet recording apparatus as set forth in claim 5, wherein the cover member including at least the protrusion is made of a material having a stiffness not greater than a stiffness of a material composing the cap member.

8. The ink jet recording apparatus as set forth in claim 5, wherein the first abutment protrusion is formed on a peripheral portion of a top face of the cover member; and wherein a second abutment protrusion is formed on the top face of the cover member at a portion surrounded by the first abutment protrusion.

9. The ink jet recording apparatus as set forth in claim 1, wherein the suction member gives the negative pressure when the protrusion defines the narrow gap.

10. The ink jet recording apparatus as set forth in claim 1, wherein a face of the cover member to be abutted against the nozzle face is configured to be a hydrophilic surface.

11. The ink jet recording apparatus as set forth in claim 10, wherein an inner face of the cap member defining the internal space is configured to be a hydrophobic surface except for the hydrophilic surface.

12. The ink jet recording apparatus as set forth in claim 1, wherein the cover member and the cap member are provided as an integral member.

13. The ink jet recording apparatus as set forth in claim 1, wherein the cover member covers the nozzle orifice during quiescent time of the apparatus.

14. The ink jet recording apparatus as set forth in claim 1, wherein the cover member is provided with a protrusion which faces the nozzle face while defining a gap therebetween to cover the nozzle orifice when the cap member seals the nozzle face.

15. An ink recording apparatus comprising:

a recording head including a pressure chamber to which ink is supplied, a nozzle face provided with a nozzle orifice communicated with the pressure chamber, and an element for generating pressure in the pressure chamber to eject an ink drop from the nozzle orifice;

a cap member for sealing the nozzle face while defining an internal space therein;

a cover member provided in the internal space of the cap member, which is to be brought into intimate contact with the nozzle face to cover the nozzle orifice when the cap member seals the nozzle face; and a suction member for giving negative pressure to the internal space of the cap member, wherein a face of the cover member to be abutted against the nozzle face includes an inclined face.

16. The ink jet recording apparatus as set forth in claim 15, wherein the cover member is made of a material having a stiffness not greater than a stiffness of a material composing the cap member.

17. The ink jet recording apparatus as set forth in claim 15, wherein a face of the cover member to be abutted against the nozzle face is configured to be a hydrophilic surface.

18. The ink jet recording apparatus as set forth in claim 17, wherein an inner face of the cap member defining the internal space is configured to be a hydrophobic surface for the hydrophilic surface.

19. The ink jet recording apparatus as set forth in claim 15, wherein the cover member and the cap member are provided as an integral member.

20. The ink jet recording apparatus as set forth in claim 15, wherein the cover member covers the nozzle orifice during quiescent time of the apparatus.

* * * * *